US005988626A

United States Patent [19]

La Vos et al.

[11] Patent Number: 5,988,626

[45] Date of Patent: Nov. 23, 1999

[54] APPARATUS FOR SEPARATING AND CARRYING OFF THE TOPMOST SHEET OF A STACK

[75] Inventors: Peter George La Vos, Ma Baarlo; Frederik Gerardus Heeman, Am Venlo; Petrus Johannes M. Thissen, Jk Heythuysen; Pals Gerrit Faber, Et Venlo, all of Netherlands

[73] Assignee: Oce-Technologies B.V., Ma Venlo, Netherlands

[21] Appl. No.: 08/827,611

[22] Filed: Apr. 9, 1997

[30] Foreign Application Priority Data

Apr. 9, 1996 [NL] Netherlands ..... 1002819

[51] Int. Cl.[6] ..... B65H 3/12

[52] U.S. Cl. ..... 271/96; 271/98; 271/106; 271/108

[58] Field of Search ..... 271/94, 96, 98, 271/105, 106, 108

[56] References Cited

U.S. PATENT DOCUMENTS

| | | | |
|---|---|---|---|
| 3,595,563 | 7/1971 | Rostoker . | |
| 4,345,752 | 8/1982 | Nakamura et al. | 271/94 |
| 4,451,028 | 5/1984 | Holmes et al. | 271/94 |
| 4,627,605 | 12/1986 | Roller et al. | 271/94 |
| 4,662,622 | 5/1987 | Wimmer et al. | 271/96 |
| 5,150,892 | 9/1992 | Shimizu . | |
| 5,181,706 | 1/1993 | Yamamoto et al. | 271/96 |
| 5,478,066 | 12/1995 | Yoshida et al. | 271/94 |
| 5,707,056 | 1/1998 | Rauen et al. | 271/96 |

FOREIGN PATENT DOCUMENTS

507661A1 3/1992 European Pat. Off. .

*Primary Examiner*—H. Grant Skaggs
*Attorney, Agent, or Firm*—Birch, Stewart, Kolasch & Birch, LLP

[57] ABSTRACT

Apparatus for separating the topmost sheet from a stack of sheets with a suction belt conveyor disposed a short distance above the stack. The suction belt conveyor includes a suction box around which an endless suction belt is trained. In one corner the suction box has a lower resistance to air flow than in the rest of the suction box in order to unroll the top-most sheet by sucking it against the suction box. The lower resistance to air flow is obtained by disposing except in the said corner a plate at a short distance above the perforated base of the suction box. Near the corner of the suction box air is forced against the side of the stack in order to assist the unrolling suction operation. The suction belt is provided with peripheral ribs which deform the applied sheet in order to assist separation.

21 Claims, 6 Drawing Sheets

APPARATUS FOR SEPARATING AND CARRYING OFF THE TOPMOST SHEET OF A STACK

BACKGROUND OF THE INVENTION

1. Field of the Invention

The invention relates to an apparatus for separating and carrying off the topmost sheet from a stack of sheets. A support is provided for supporting the stack of sheets. A sheet transport member is disposed above the stack and the bottom of the transport member is provided with air passages with different air flow resistances. A positioning member holds the sheet transport member at a short distance above the stack. An air displacement member generates an upwardly directed airstream through the air passages.

2. Description of Background Art

An apparatus of this kind is set forth in U.S. Pat. No. 5,150,892. The apparatus described therein has a sheet transport path with a suction box surrounded by four porous conveyor belts disposed near one another. The suction box is provided with air passage apertures through which an upwardly directed air stream can take place to suck the topmost sheet against the conveyor belts. In this known apparatus, the air passages in the case of a sheet which is not sucked into contact are closed by a valve at the outermost conveyor belts so that when the air flow is activated the topmost sheet is initially sucked against the middle conveyor belts, so that the negative pressure in the suction box increases and the valves at the outermost air passages open, with the result that parts of the sheet situated next to the part of the sheet which has already been sucked into contact are sucked against the suction box.

A disadvantage of this known apparatus is that a relatively considerable force is required in order to pull the topmost sheet loose first in the middle of the stack. This is produced by the fact that sucking the topmost sheet up results in a strong negative pressure in the middle beneath the topmost sheet, and this necessitates an even stronger upwardly suction force from the sheet transport means in order to pull the topmost sheet loose.

If the negative pressure between the sheets is greater between the topmost sheet and the sheet directly therebeneath than between the sheets under the topmost sheet, then there is a considerable risk that the two topmost sheets will be sucked together against the sheet transport means.

A disadvantage of first sucking a sheet in the middle and only then at its sides, is that the curvature of a sheet in the middle requires an extra high suction force if the sheet for sucking is stiff and/or can slide only with difficulty over the sheet therebeneath.

SUMMARY AND OBJECTS OF THE INVENTION

The object of the invention is to provide an apparatus for separating and carrying off the topmost sheet from a stack of sheets without the above disadvantages. To this end, according to the invention, a first air passage is situated close to an edge portion of the stack on the support and has a lower resistance to air flow than a second air passage situated further away from said edge portion.

As a result, the top sheet is "unrolled" from the edge portion of the stack so that air can readily flow between the topmost sheet and the rest of the stack to assist the separation of the topmost sheet from the stack. Another effect is that a greater static and dynamic negative pressure can be generated at the required place above the stack.

By situating the first air passage close to the side of the stack where the topmost sheet can be carried off from the stack, air can readily flow from the front of the stack in order to cancel out the created negative pressure between the sheets. If forced air is used to intensify this flow, this forced air also assists in retaining following sheets when the topmost sheet is carried off.

By situating the first air passage in one of the edge areas of the sheet transport means which extends in a direction parallel to the direction in which the topmost sheet can be carried off from the stack, air can readily flow from a side of the stack. If forced air is used to assist this flow, this forced air also assists in blowing the topmost sheets loose from the stack.

Preferably, the first air passage is situated in an area of the sheet transport means which is situated solely close to a corner of the sheet transport means, which area is bounded by a line intersecting two perpendicularly situated edges of the sheet transport means. Consequently, the unrolling of the topmost sheet from the stack can take place from a corner where air can readily flow in from the front and from a side of the stack for effective suction of the topmost sheet to the transport means.

If the area in which the first air passage is situated at the front of the stack where the topmost sheet can be carried off is bounded by a line situated a short distance from said front straight above and parallel to the front edge of the stack of sheets therebeneath, then, on the separation of sheets having binder holes at the front, first air passage apertures do not extend at the location of these binder holes and this is of an advantage to the efficiency of the apparatus.

In one advantageous embodiment of an apparatus according to the invention, the bottom of the sheet transport means has an outer wall provided with a regular pattern of air passage apertures and an inner wall situated at a short distance thereabove and having, close to a portion of a stack of sheets lying on the support, an aperture having a larger section than the short distance between the outer and inner walls.

Consequently, the first air passage can readily be formed by a plate forming the inner wall, one corner of the plate being cut off to form the first air passage.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Hereinafter, a preferred embodiment of the present invention will be described with reference to the drawings.

Figure 1:
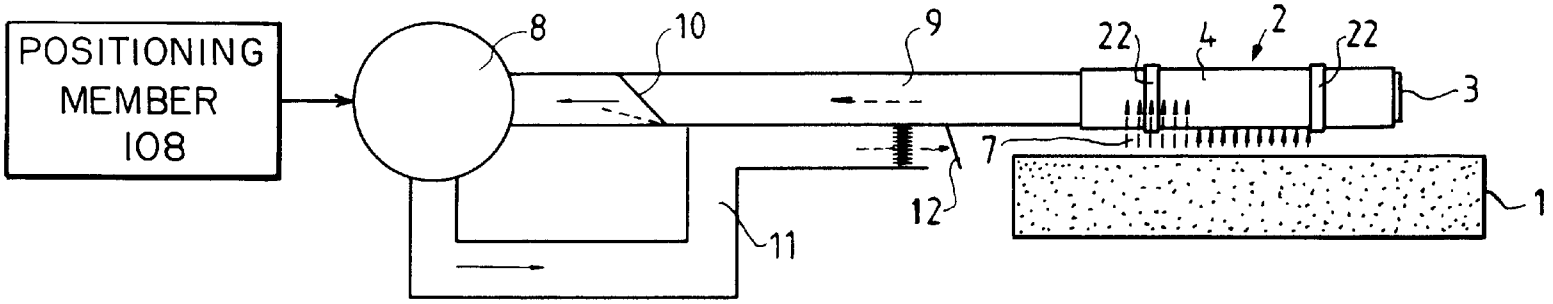
FIG. 1 is a view of an apparatus in which the invention can be applied.
Figure 2:
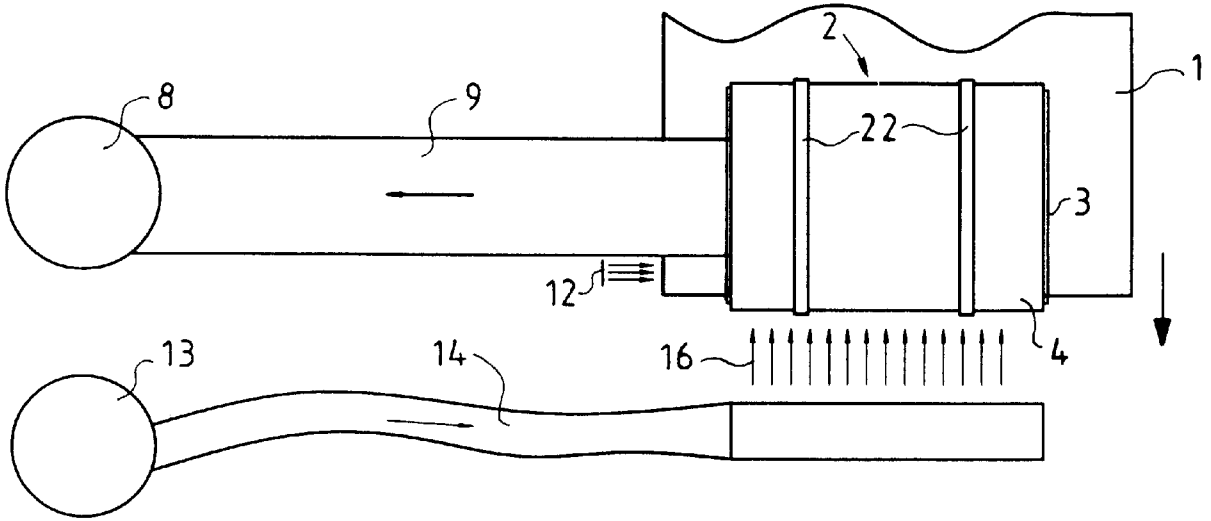
FIG. 2 is a top plan view of the apparatus shown in FIG. 1.
Figure 3:
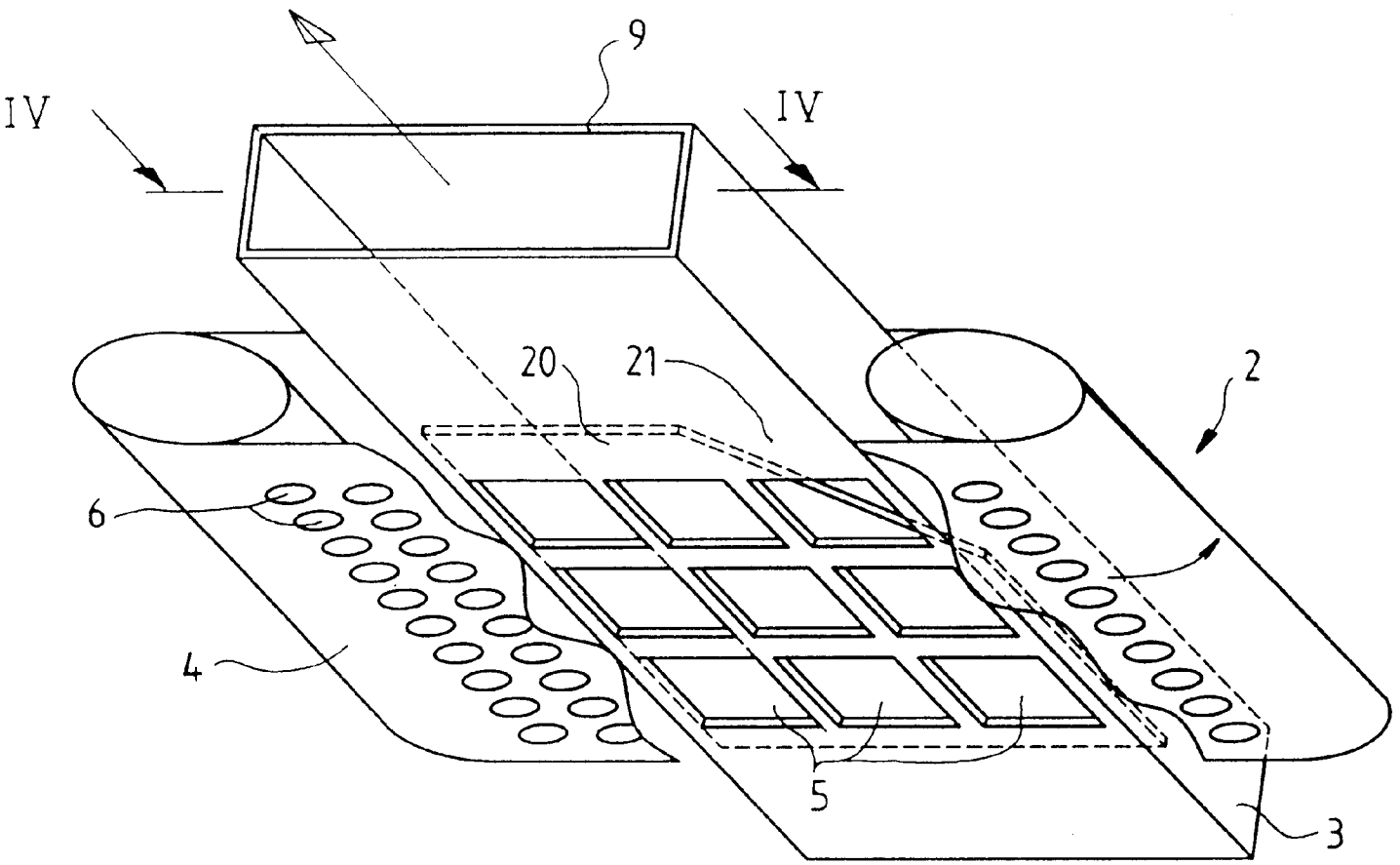
FIG. 3 is a perspective view of a sheet transport means for use in the apparatus shown in FIGS. 1 and 2.
Figure 5:
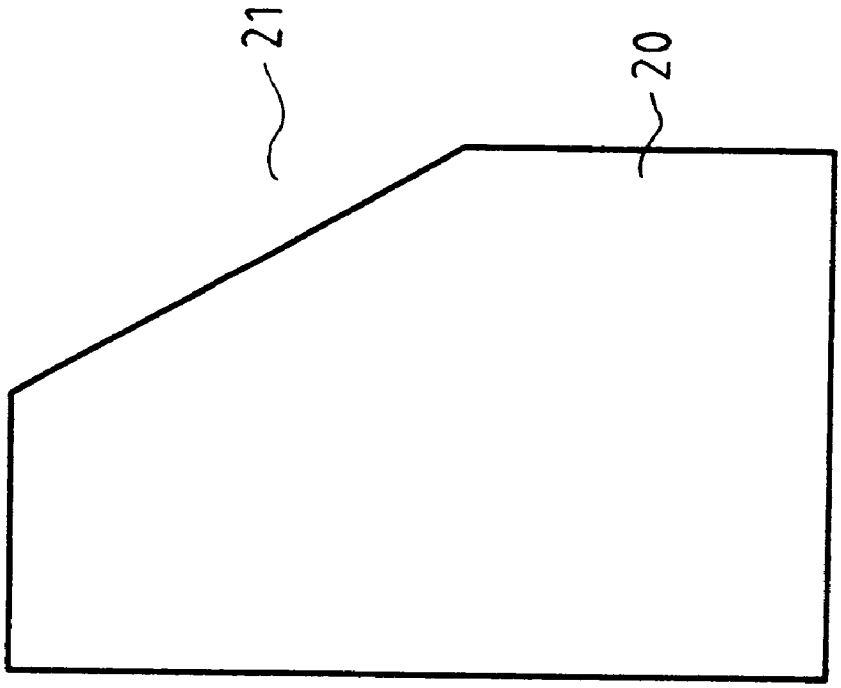
FIG. 5 is an essential part of the apparatus shown in FIGS. 3 and 4.
Figure 4:
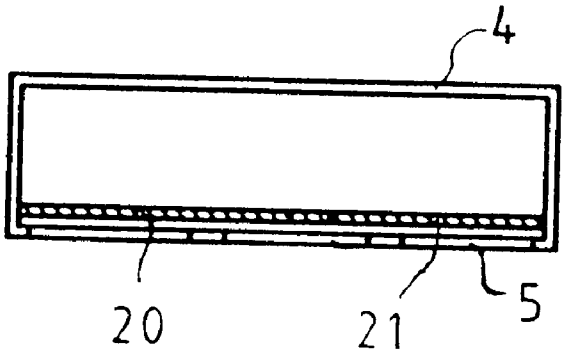
FIG. 4 is a cross-section on the line IV—IV in FIG. 3.

The apparatus shown in FIGS. 1 and 2 for separating and carrying off the top sheet of a stack of sheets 1 is suitable for feeding receiving sheets one by one from a supply holder to a printing device (not shown), in which these receiving sheets can be printed. The apparatus illustrated comprises a suction belt conveyor 2 disposed above the stack of sheets 1 and consisting of a fixed suction box 3 having an endless conveyor belt 4 trained around it. The bottom of the suction box 2 and the conveyor belt 4 are both formed with holes 5, 6, respectively, in a regular pattern as shown in FIG. 3. At places where the holes 5 and 6 register, air passages are formed, through which an upwardly directed airstream can take place as shown by arrows 7 in FIG. 1. This airstream 7 is produced by a fan 8 the intake side of which is connected by an intake conduit 9 to the suction box 2. A solenoid valve 10 is provided in the intake line 9 and is adapted to be operated by a control system (not shown) which enables the upwardly directed airstream 7 to be operative when the fan 8 is in operation, to suck the top sheet of the stack 1 against the suction belt conveyor 2. The sheet separated from the stack is then removed from the stack 1 by means of the movement of the conveyor belt 4. On the entry of the sheet to a transport nip (not shown) in the discharge path, the drive for the endless conveyor belt 4 is stopped and the vacuum in the suction box 3 is switched off.

The delivery side of the fan 8 is connected to a delivery line 11 which is discharged at one side of the stack of sheets 1. When the valve 10 is opened and the top sheet of the stack 1 has not yet been sucked against the suction belt conveyor, the fan 8 blows into the delivery line 11 the air drawn in via the intake conduit. Above a specific pressure in the delivery conduit 11 the air presses a freely suspended valve 12 open and the air flows out in the direction of the side of the stack of sheets 1 in order to fan out the top sheets and push the topmost sheet up in the direction of the suction belt conveyor 2. During the blowing of the top sheets away from one side of the stack the incoming air forms a nucleus for the injection of air between these sheets in order to separate them. Instead of the passive valve 12 it is possible to use an actively controlled valve in the delivery conduit 11, which valve in the active state does not eject the air towards the stack but directs the air elsewhere. A valve activated by a control device (not shown) has the advantage that the geometry of the air flowing out of the delivery conduit 11 is less dependent on a variable distance between the delivery conduit 11 and the side of the stack such as occurs in stacks of different widths. Another advantage of an actively controlled valve in the delivery conduit 11 is that there is no unnecessary blowing action when the sheets being processed are formed with binder holes, in which case air is drawn in via these holes. Such intake is prevented by activating the valve in good time so that the air is forced out not at the stack but is forced out elsewhere.

Also, a fan 13 blows air via a conduit 14 obliquely upwards against the front of the top sheet released from the stack, so that any following sheets can be separated from the topmost sheet. The airstream blown against the stack thus serves to assist in separating only the topmost sheet of the stack by creating a positive pressure between the topmost sheet and the rest of the stack during the creation of a negative pressure above the topmost sheet by the upwardly directed airstream 7. The positive pressure continually pressing onto the stack those sheets which are situated beneath the topmost sheet, in order to prevent the removal of the underlying sheets.

If the topmost sheet covers all the holes 5 in the suction box 2, then there is no volume flow through the fan 8, so that, if a passive valve 12 is used, it closes automatically while, if an active valve is used, it is controllably activated and no more air is delivered against the side of the stack so that the fanning out of sheets situated beneath the topmost sheet ceases and is only repeated on separation of the next topmost sheet introduced by the re-opening of the solenoid valve 10. (This valve 10 was closed on transfer of the previous topmost sheet to the transport nip in the discharge path). The above-described operation with a passive valve is assumed to be known from U.S. Pat. No. 3,595,563.

In order to improve separation of the topmost sheet, a closed plate 20 is provided in the suction box 2 at a short distance above the holes 5 in the bottom of the box. This plate 20 is provided with a bevel 21 at a corner directed towards the discharge side and one side of the stack. When the valve 10 is opened, fan 8 produces a strong upwardly directed airstream 7 which is located practically exclusively at the bevel 21 since the airstream, in this area, experiences no obstruction from the plate 20. As a result, a corner portion of the topmost sheet of the stack 1 will be lifted for release and shuts off the holes 5 and 6 at the bevel 21.

If the air circulation by means of the fan 8 continues, after the relevant holes 5 and 6 have been shut off, the air is compelled to flow via the narrow space between the bottom of the suction box 3 and the plate 20 and then via the bevel 21 to the intake conduit. This takes place with increasing resistance with increasing distance between the bottom of the suction box 3 and the plate 20 for the air flow to reach the bevel 21, with the result that the first sheet sucked against the suction box 3 near the bevel 21 is gradually sucked from said bevel against the entire suction surface of the suction box.

After the topmost sheet of the stack has thus completely unrolled against the suction box 3 the movement of the conveyor belt 4 is started and the sheet sucked into contact is removed from the stack. During the suction and discharge of the topmost sheet, air originating from the delivery conduit 14 continuously blows the sheets situated beneath the topmost sheet, which have been sucked into contact, onto the stack by pressure build-up in order to prevent these sheets from being entrained with the sheet sucked against the suction belt conveyor 2.

This pressure build-up is present to an increased extent if the suction belt conveyor is arranged with an inclination, being slightly higher on the discharge side than on the opposite side. In order to ensure that the forced air can penetrate satisfactorily between the topmost sheet and the sheet directly therebeneath, the outside of the endless belt 4 is provided with ribs 22 which extend symmetrically and parallel to the direction of transport of the endless belt 4. On suction of the topmost sheet against the conveyor belt 4 to unroll the sheet, the sheet will follow the contours of the ribs 22 and thus be sucked into contact in a deformed state. Any sheet possibly sticking to the topmost sheet will, as a result of its stiffness, be less satisfactorily able to follow the contours of the ribs 22 so that a space will form between the top two sheets, with the forced air penetrating therebetween in order to provide further separation. The ribs 22 on the endless belt 4 form a relief therebetween.

The advantage of ribs 22 on the endless belt 4 for deformed contact of the topmost sheet, in comparison with ribs on the suction box between the endless belts as disclosed in U.S. Pat. No. 5,150,892 is that there is no relative movement between the rib and the sheet when the latter is carried away by the ribbed endless belt 4. As a result of the absence of any braking frictional force between the rib and the sheet, the available transport power is greater for a specific negative pressure in the suction box. The use of ribs 22 on the endless conveyor belt 4 also offers the possibility of using a single (wide) conveyor belt, something which is advantageous for the belt control.

Because of the continuous closed belt surface, a ribbed endless conveyor belt causes less soiling and/or risk of damage to the sheets for removal, such sheets possibly containing an image thereon, while the air passages can extend to near or even as far as the rib. It will be clear that the above advantages of one ribbed suction belt instead of suction belts on either side of a rib on the suction box can also be achieved with a suction box provided with air passages having equal resistance to air flow.

Figure 6B:
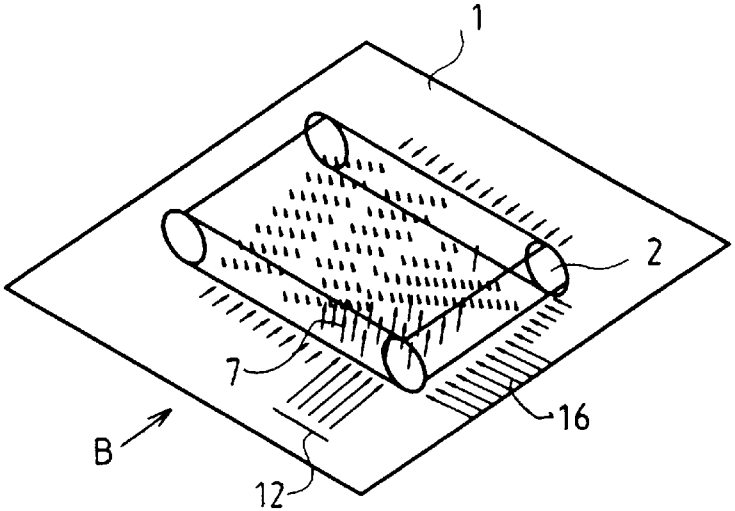
FIG. 6(B) illustrates the operation of the apparatus according to the present invention.
Figure 6A:
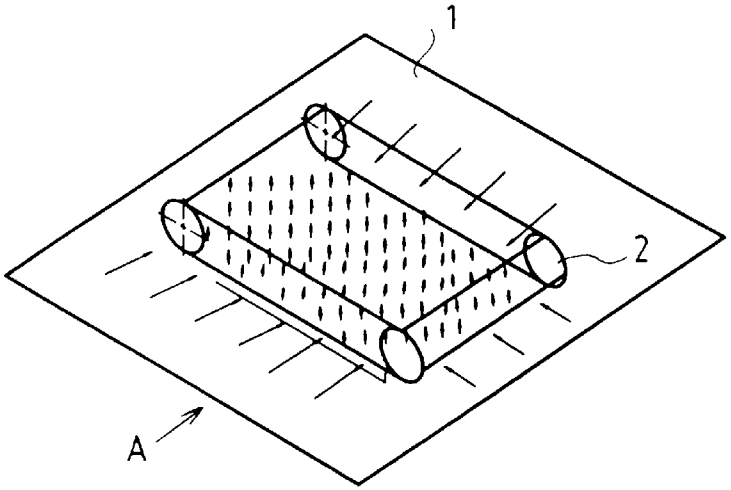
FIG. 6(A) illustrates a known suction belt.

FIGS. 6(A) and 6(B) show two situations of a suction belt conveyor with a sheet situated therebeneath which is required to be sucked against the suction belt conveyor. FIG. 6(A) shows a known assumed situation in which an upwardly directed airstream is created at the bottom of the suction belt conveyor and has substantially the same intensity over the entire operative surface of the suction box and wherein the flow of air from the side edges and the front is also substantially uniformly distributed as shown in FIG. 6(A). Since the upwardly directed airstream must be sufficient, for each unit of area of the suction belt conveyor, to suck the topmost sheet into contact and this upwardly directed airstream is operative uniformly over the entire bottom surface of the conveyor, this relatively large quantity of air will have to flow from the sides of the stack. These relatively considerable air movements result in a proportionally high noise generation.

In contrast to the device shown in FIG. 6(A) and assumed to be known, in the device according to the invention as shown diagrammatically in FIG. 6(B) the upwardly directed airstream is not distributed uniformly beneath the suction belt conveyor. By constructing a corner portion of the bottom of the suction belt conveyor with a lower resistance to air flow than the rest of the bottom of the suction belt conveyor, the part having the lower resistance to airflow will result in the formation of a larger upwardly directed airstream than in the part having the higher resistance to air flow, as denoted by the upwardly directed arrows in FIG. 6(B).

It will be apparent that near that corner portion the flow of air from the sides of the stack must be greater than along the rest of the sides of the stack, as shown by arrows in FIG. 6(B). A stronger static negative pressure will form locally in accordance with Bernouilli's law as a result of this greater inflow of air from the side of the stack at said corner portion, and said stronger static negative pressure lifts the sheet further at said corner portion so that the sheet can be locally more readily sucked against the suction belt conveyor. The blowing of air against the stack enhances this Bernouilli effect.

As a result of the stronger air flow near a corner portion of the suction belt conveyor, the sheet will initially be sucked against the suction belt conveyor near said corner portion and only then gradually against the rest of the suction belt conveyor. As a result of this "unrolling" of the sheet during the suction operation, the sheet can be sucked flat against the suction belt without causing false folds in the sheet. It is preferable to assist the unrolling suction operation by blowing air against the stack near the first operative part of the suction belt conveyor in support of the greater air inflow near said first operative part, as shown in FIG. 6(B). This forced inflow is also important for the purpose of blowing air beneath the lifted sheet part during the lifting of the sheet in order to cancel out the negative pressure between the topmost sheet and the sheets therebeneath.

By providing the outer surface of the endless suction belt with a relief, a space is mechanically created between the topmost sheet which, when the sheet is sucked against the suction belt conveyor, follows the belt relief while the sheet therebeneath can follow said relief less satisfactorily. The space created forms a nucleus for blowing air beneath the sheet sucked into contact, and this promotes retention of a following sheet on removal of the top sheet by the suction belt conveyor.

The deformation of sheets in order to facilitate the blowing loose of the sheets can also be assisted by placing the stack on a bent support. If the support is at a higher level at the sheet discharge side than at the opposite side, the sloping surface prevents the stack of sheets sliding away towards the discharge side. As a result of the bend in the support, the stack of sheets undergoes deformation to some extent, the freed topmost sheet tending to stretch so that it is loosened from the rest of the stack with the formation of a space which forms a nucleus for the blowing of air beneath the topmost sheet. However, the effect according to the invention is obtained even without this bend.

Figure 7:
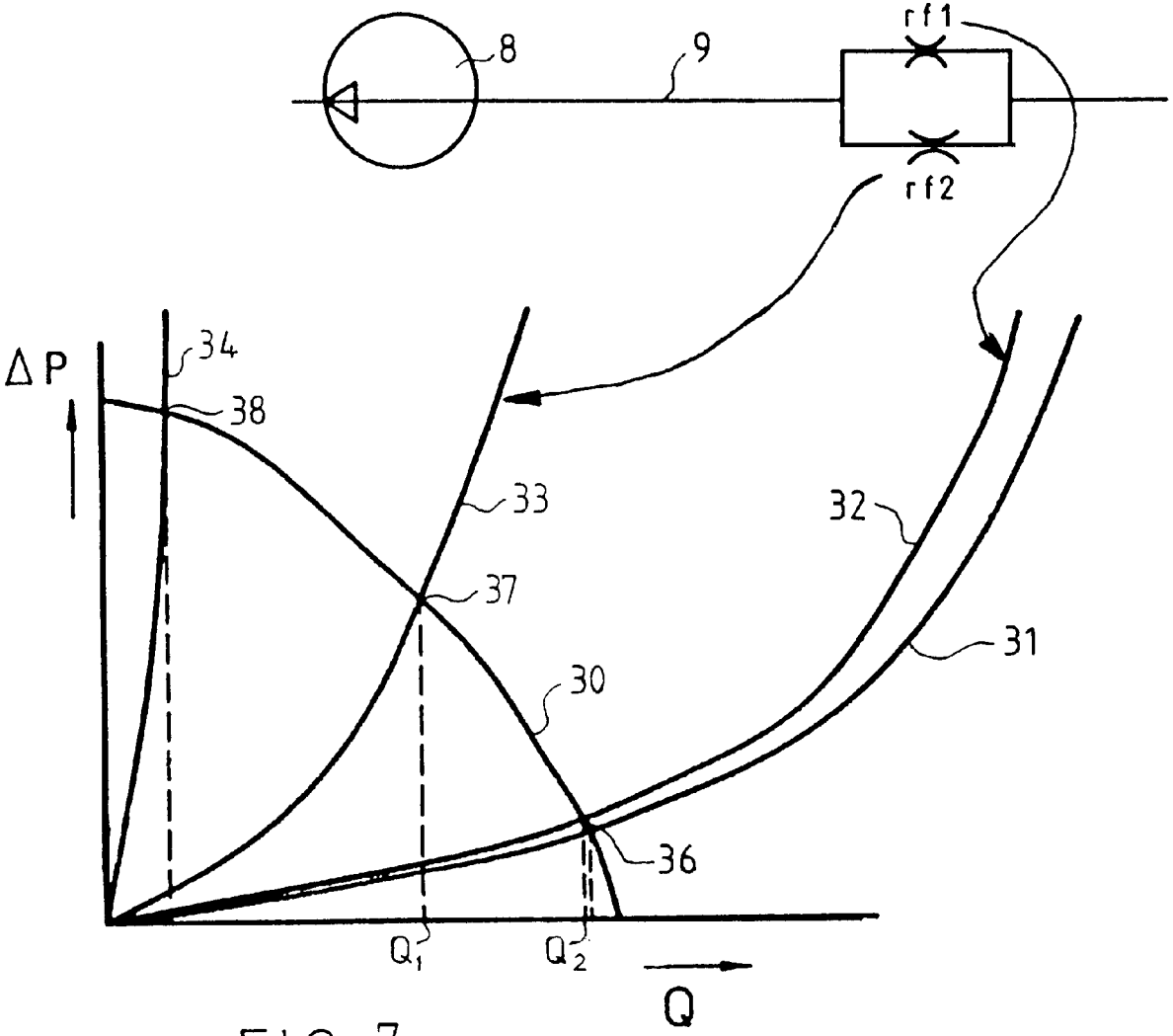
FIG. 7 is a graph showing the relationship between negative pressure and air flow in the sheet transport means shown in FIG. 3.

The operation of the embodiment shown in FIGS. 1–5 and 6(B) will now be explained further by reference to FIG. 7, in which the pressure difference $\Delta p$ generated by fan 8 is plotted against the quantity of air Q moved by the fan 8 per unit of time. The curve 30 shown graphically in the drawing illustrates the fan characteristic. This characteristic curve 30 indicates the course of the quantity of air Q moved per unit of time for different pressure differences $\Delta p$ produced by the fan between the intake side and the delivery side thereof. The position of curve 30 depends on the construction and speed at which the moving parts of the fan rotate. In a fan there is a relationship between $\Delta p$ and Q, the air movement Q decreasing with increasing pressure difference $\Delta p$. FIG. 7 also shows a number of curves 31, 32, 33 and 34 characteristic of the conduits in the air circulation system of which a fan forms part.

According to these conduit characteristics, the resistance of the conduit is proportional to the square of the speed of the air in the conduit, so that the resistance increases intensively for an increasing quantity of air Q moved per unit of time. By increasing the resistance experienced by the air on flow through the air circulation system, the conduit characteristic curve becomes steeper and steeper, as indicated by curves 32, 33 and 34, the very steep curve 34 applying to a practically closed air circulation system, as is the case when a sheet is completely sucked against the belt conveyor and only leakage air is conveyed through the system.

Conduit characteristics 31 applies when a sheet is completely free of the belt conveyor, the air flow resistance $rf_1$ at the cut-off part 21 of plate 20 in the suction box 3 and the air flow resistance $rf_2$ at the rest of the plate 20 in the suction box 3 being interpreted as two parallel resistances. Conduit characteristic 33 relates to the situation in which the suction box is closed only at the straight cut-off part 21 of plate 20 by a sheet sucked into contact. The instantaneous conduit characteristic determines the point where the fan will operate on the fan characteristic curve. Thus point of intersection 36 indicates the quantity of air moved per unit of time if a sheet is not sucked into contact. On closure of the part of the suction box with resistance $rf_1$, the point of intersection moves rapidly to point of intersection 37. On the subsequent unrolling of the sheet against the suction box, the point of intersection moves slowly to point 38 which applies to the suction box being completely closed. During the unrolling movement the air has to flow over a continually increasing distance through the narrow space between the bottom of the suction box 3 and the plate 20, resulting in an increased resistance. The fact that the resistance lines 31 and 32 are close together means that when air passes freely through all parts of the suction box openings the air enters practically exclusively through the corner part of the suction box, which has the minimum resistance.

As a result of the relatively high air velocity at the corner part of the suction box, it is possible to suck up a sheet situated relatively far beneath the suction box. If this air velocity were embodied over the entire suction surface of the suction box, a high air velocity would remain for a long period, resulting in increased noise level. By constructing the suction box in accordance with the invention with parts having different air flow resistances, with the minimum resistance near a corner of the sheet, a considerable suction effect is achieved for a low volumetric flow, the latter resulting in lower noise production, and promoting an environmentally friendly operation of the apparatus while reducing the risk of two sheets being simultaneously sucked against the suction belt conveyor. Since the force with which a completely applied sheet is retained by the suction belt conveyor is determined by the area of the suction box suction surface, the transport force is maintained even with a suction box having areas of different air flow resistances.

Figure 8:
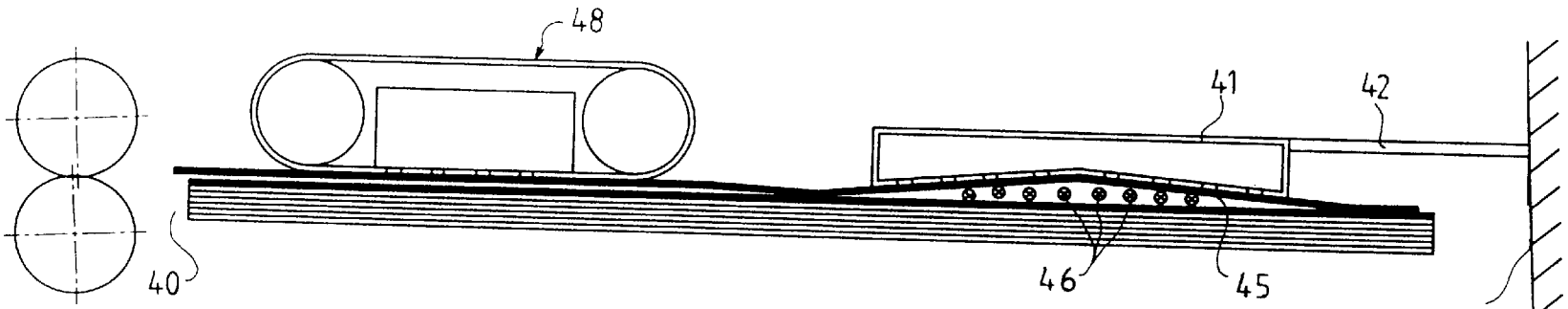
FIG. 8 is a view of another apparatus for separating and carrying off the topmost sheet from a stack.

In the apparatus shown in FIGS. 1 to 6(B), the suction belt conveyor 2 serves both to release the topmost sheet from the stack by lifting it and to carry off the loosened sheet from the stack. These two functions can also be carried out by separate means as shown in FIG. 8. A suction box 41 rests by its own weight on the stack on the rear half thereof situated remote from the side 40 where sheets are removed from the stack. Suction box 41 is connected by a leaf spring 42 to a fixed frame 43 in order to give the suction box some mobility vertically. Suction box 41 has a convex baseplate 45 provided with suction apertures. This curvature extends over the entire width of the suction box 41. Blowing nozzles are disposed on either side of the stack opposite the suction box 41 and compressed air is forced from them into the space between the convex bottomplate 45 and the stack of sheets, as denoted by references 46. With negative pressure in the suction box 41 the topmost sheet of the stack is sucked against the convex bottom plate 45, whereupon the air 46 forced from the sides of the stack forms a pressure chamber closed at the front and rear beneath the released topmost sheet in order to press the underlying sheets firmly on the stack. In addition, as illustrated in FIG. 1, the suction belt conveyor 2 may be held above the sheets 1 by a positioning member or means 108.

Equilibrium occurs in these conditions between the air pressure in the pressure chamber and the weight of the suction box 41. The latter can be constructed in the same way as the suction box 3. In this released condition of the topmost sheet, the conveyor 48 disposed above the front half of the stack carries off the topmost sheet from the stack, the compressed air 46 ensuring that sheets therebeneath are pressed firmly on one another in order to generate a retaining force to prevent the discharge of such sheets. The magnitude of the retaining force depends on the weight of the suction box 41, which is held in suspension by the pressure of the injected air.

Although the invention has been explained by reference to the embodiment described, it is not restricted thereto. It will be clear to the skilled addressee that other embodiments are possible within the scope of the following claims. For example, air passage apertures in the suction box can have different restrictions in order to produce differences in flow resistances or can be embodied by areas in the suction box with different flow resistances in some other manner obvious to the skilled addressee.

We claim:

1. An apparatus for separating and carrying off the topmost sheet from a stack of sheets comprising:

a support to support a stack of sheets;

a sheet transport means disposed above the stack, the bottom of the sheet transport means being provided with air passages with different air flow resistances;

positioning means to hold the sheet transport means at a short distance above the stack; and air displacement means for generating an upwardly directed airstream through the air passages;

a first air passage situated close to a corner portion of the stack on the support includes a lower resistance to air flow for producing a predetermined upwardly directed airstream at said corner relative to an airstream from a second air passage situated further away from said corner portion.

2. The apparatus according to claim 1, wherein the first air passage is situated close to the edge of the stack where the topmost sheet can be carried off from the stack.

3. The apparatus according to claim 2, wherein the first air passage is situated in an area of the sheet transport means which is situated solely close to a corner of the sheet transport means.

4. The apparatus according to claim 3, wherein the area in which the first air passage is situated at a front of the stack where the topmost sheet can be carried off is bounded by a line situated a short distance from said front of the stack straight above and parallel to the front edge of the stack of sheets therebeneath.

5. The apparatus according to claim 4, wherein the bottom of the sheet transport means has an outer wall provided with a regular pattern of air passage apertures and an inner wall situated at a short distance thereabove and having, close to the said edge portion of a stack of sheets lying on the support, an aperture having a larger section than the short distance between the outer and inner walls.

6. The apparatus according to claim 3, wherein the bottom of the sheet transport means has an outer wall provided with a regular pattern of air passage apertures and an inner wall situated at a short distance thereabove and having, close to the said edge portion of a stack of sheets lying on the support, an aperture having a larger section than the short distance between the outer and inner walls.

7. The apparatus according to claim 2, wherein the area in which the first air passage is situated at a front of the stack where the topmost sheet can be carried off is bounded by a line situated a short distance from said front of the stack straight above and parallel to the front edge of the stack of sheets therebeneath.

8. The apparatus according to claim 7, wherein the bottom of the sheet transport means has an outer wall provided with a regular pattern of air passage apertures and an inner wall situated at a short distance thereabove and having, close to the said edge portion of a stack of sheets lying on the support, an aperture having a larger section than the short distance between the outer and inner walls.

9. The apparatus according to claim 2, wherein the bottom of the sheet transport means includes a suction box having an outer wall provided with a regular pattern of air passage apertures and a plate situated at a short distance thereabove and having, close to the said edge portion of a stack of sheets lying on the support, a bevel having a larger section than the short distance between the outer walls and the plate.

10. The apparatus according to claim 1, wherein the first air passage is situated close to one of the edge areas of the sheet transport means which extends in a direction parallel to the direction in which the topmost sheet can be carried off from the stack.

11. The apparatus according to claim 10, wherein the first air passage is situated in an area of the sheet transport means which is situated solely close to a corner of the sheet transport means.

12. The apparatus according to claim 11, wherein the area in which the first air passage is situated at a front of the stack where the topmost sheet can be carried off is bounded by a line situated a short distance from said front of the stack straight above and parallel to the front edge of the stack of sheets therebeneath.

13. The apparatus according to claim 12, wherein the bottom of the sheet transport means has an outer wall provided with a regular pattern of air passage apertures and an inner wall situated at a short distance thereabove and having, close to the said edge portion of a stack of sheets lying on the support, an aperture having a larger section than the short distance between the outer and inner walls.

14. The apparatus according to claim 11, wherein the bottom of the sheet transport means has an outer wall provided with a regular pattern of air passage apertures and an inner wall situated at a short distance thereabove and having, close to the said edge portion of a stack of sheets lying on the support, an aperture having a larger section than the short distance between the outer and inner walls.

15. The apparatus according to claim 10, wherein the bottom of the sheet transport means has an outer wall provided with a regular pattern of air passage apertures and an inner wall situated at a short distance thereabove and having, close to the said edge portion of a stack of sheets lying on the support, an aperture having a larger section than the short distance between the outer and inner walls.

16. The apparatus according to claim 1, wherein the bottom of the sheet transport means has an outer wall provided with a regular pattern of air passage apertures and an inner wall situated at a short distance thereabove and having, close to the said edge portion of a stack of sheets lying on the support, an aperture having a larger section than the short distance between the outer and inner walls.

17. The apparatus according to claim 1, wherein blowing means are provided and are disposed near the edge portion of a stack of sheets on the support for blowing air from the sheet transport means against the edges of the sheets of the stack.

18. The apparatus according to claim 17, wherein the blowing means have an air flow aperture provided with a valve to be opened by flowing air.

19. The apparatus according to claim 17, wherein the blowing means have an air flow duct provided with a valve adapted to be activated by a control device.

20. The apparatus according to claim 1, wherein the sheet transport means has a relief.

21. The apparatus according to claim 20, wherein the relief is formed by at least one rib on an endless suction conveyor belt forming the sheet transport means, said rib extending over the conveyor belt parallel to the discharge direction.

* * * * *